US011156336B1

(12) United States Patent
Kim

(10) Patent No.: US 11,156,336 B1
(45) Date of Patent: Oct. 26, 2021

(54) LIGHTING APPARATUS FOR VEHICLE

(71) Applicants: Hyundai Motor Company, Seoul (KR); Kia Motors Corporation, Seoul (KR)

(72) Inventor: Hyeong Seon Kim, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 17/081,121

(22) Filed: Oct. 27, 2020

(30) Foreign Application Priority Data

Jun. 11, 2020 (KR) ..... 10-2020-0070880

(51) Int. Cl.
*F21S 41/00* (2018.01)
*F21S 41/63* (2018.01)
*F21S 41/20* (2018.01)

(52) U.S. Cl.
CPC ..... *F21S 41/635* (2018.01); *F21S 41/285* (2018.01)

(58) Field of Classification Search
CPC ..... B60Q 1/0011; F21S 43/255–27; F21S 43/19–251; F21S 41/635
See application file for complete search history.

(56) References Cited

U.S. PATENT DOCUMENTS

| | | | | |
|---|---|---|---|---|
| 4,958,263 | A * | 9/1990 | Davenport | B60Q 1/0011 362/255 |
| 2009/0086500 | A1* | 4/2009 | Tatara | B60Q 1/076 362/512 |
| 2016/0084462 | A1* | 3/2016 | Suwa | F21S 41/255 362/511 |
| 2018/0170247 | A1* | 6/2018 | Ramos, II | B60Q 1/0041 |
| 2018/0208111 | A1* | 7/2018 | Lisseman | B60Q 3/64 |
| 2018/0274747 | A1* | 9/2018 | Wiesner | F21S 43/255 |
| 2019/0170925 | A1* | 6/2019 | Nichol | G02B 6/0088 |
| 2019/0211988 | A1* | 7/2019 | Kim | F21S 41/321 |
| 2020/0103093 | A1* | 4/2020 | Negel | F21V 3/12 |
| 2020/0198521 | A1* | 6/2020 | Erdl | F21S 41/16 |
| 2020/0339033 | A1* | 10/2020 | Lim | F21S 41/275 |
| 2020/0384914 | A1* | 12/2020 | Sugimoto | B60Q 1/2611 |
| 2020/0391657 | A1* | 12/2020 | Kindl | F21S 43/241 |

FOREIGN PATENT DOCUMENTS

KR 2017-0062405 A 6/2017

* cited by examiner

*Primary Examiner* — Gerald J Sufleta, II
(74) *Attorney, Agent, or Firm* — Mintz Levin Cohn Ferris Glovsky and Popeo, P.C.; Peter F. Corless

(57) ABSTRACT

A lighting apparatus of a vehicle is provided to allow irradiation of light to be diffused into a surrounding area together with a lighting area in which the light is irradiated. The is irradiated even from a bumper or a grille of the vehicle. In addition, in an area in which the irradiation of the light is diffused in the vehicle in addition to the lighting area, the diffusion of the light is selectively determined.

11 Claims, 7 Drawing Sheets

LIGHTING APPARATUS FOR VEHICLE

CROSS REFERENCE TO RELATED APPLICATION

The present application claims priority of Korean Patent Application No. 10-2020-0070880 filed on Jun. 11, 2020, the entire contents of which is incorporated herein for all purposes by this reference.

BACKGROUND

Field of the Disclosure

The present disclosure relates to a lighting apparatus of a vehicle, which allows irradiation of light to be diffused into a surrounding area together with a lighting area in which the light is irradiated.

Description of the Related Art

Lighting apparatuses utilizing various light sources are applied to vehicles, and each lighting apparatus is appropriately used based on a characteristic thereof according to an installation location and use. These lighting apparatuses include an indoor lighting lamp installed within a vehicle and a headlight, a fog lamp, a backup light, a sidelight, a license plate lamp, a tail lamp, a stop lamp, a turn signal lamp, and a hazard flasher lamp, which are installed on an exterior of the vehicle. In particular, since the lighting installed on the exterior of the vehicle contributes to enhancement of the vehicle even in terms of design, a lighting design and a lighting effect of the vehicle are also important.

Generally, the lighting installed in the vehicle focuses on irradiation of light toward a front side of the vehicle, and thus technological development has been carried out to focus on securing convergence and diffusivity of the light. In addition, to improve the lighting design, a shape around the lighting is altered to improve an aesthetic appearance. However, as the lamps of the vehicle are applied to a limited space with respect to a headlamp and a rear lamp of the vehicle, there occurs a limitation in design.

The foregoing is intended merely to aid in understanding of the background of the present disclosure, and is not intended to mean that the present disclosure falls within the purview of the related art that is already known to those skilled in the art.

SUMMARY

Accordingly, the present disclosure provides a lighting apparatus of a vehicle, which allows irradiation of light to be diffused into a surrounding area together with a lighting area in which the light is irradiated and thus the light is irradiated even from a bumper or a grille of the vehicle to improve an exterior design of the vehicle.

According to one aspect, a lighting apparatus of a vehicle may include a vehicle body panel having a main lighting area and an extended lighting area; a housing installed in the vehicle body panel and formed to include the main lighting area and the extended lighting area; a light source installed in the housing and configured to emit light to the outside; a light guide provided to allow the light emitted from the light source to be incident thereon, configured to irradiate light due to the incident light, and formed to extend from the main lighting area to the extended lighting area; and a lighting selection mechanism movably provided at a position at which the main lighting area and the extended lighting area are divided in the light guide and configured to selectively partition a light emission area of the light guide when the lighting selection mechanism is located at the light guide or separated therefrom, thereby allowing the light to be irradiated in only the main lighting area or allowing the light to be irradiated in both the main lighting area and the extended lighting area.

The light guide may include a main area that corresponds to the main lighting area, an extension area that corresponds to the extended lighting area, and a space area disposed between the main area and the extension area. The light source may be installed such that the light guide irradiates light toward the main area. The lighting selection mechanism may include a guide block movably disposed in the space area and configured to allow both the main area and the extension area to irradiate light based on a movement position or configured to prevent light from traveling to the extension area to irradiate the light in only the main area; and a driving mechanism installed to be connected to the guide block and configured to selectively move the guide block.

The guide block may include a transparent block portion formed to allow light to pass there through and a non-transparent block portion formed to prevent the light from passing there through. The driving mechanism may include a roller provided to come into contact with a side end of the guide block in a direction in which the guide block is moved, and a driver configured to provide a driving force to rotate the roller. The roller may be provided as a plurality of rollers spaced apart from each other in a length direction of the guide block, and a friction belt that surrounds each roller may be interposed between the roller and the guide block to rotate the friction belt due to rotation of the roller to move the guide block.

The light guide may be formed in a shape in which the main area is bent inward to be recessed, and the light source may be installed to emit light toward an end of a bent portion of the light guide. The light guide may include an image forming portion configured to cut off or scatter light in an extension direction so that a lighting image emitted through the light guide may be determined.

The lighting apparatus may further include an outer lens installed in the housing, formed to cover the light guide, and configured to allow light to pass there through. In the vehicle body panel, the main lighting area may be a portion in which a lamp module including the housing, the light source, and the light guide is installed, and the extended lighting area may be a portion in which a bumper or a grille of the vehicle is provided and a lighting hole through which light passes is formed.

BRIEF DESCRIPTION OF THE DRAWINGS

The above and other objects, features and other advantages of the present disclosure will be more clearly understood from the following detailed description when taken in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor and is specifically programmed to execute the processes described herein. The memory is configured to store the modules and the processor is specifically configured to execute said modules to perform one or more processes which are described further below.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Hereinafter, a lighting apparatus of a vehicle according to exemplary embodiments of the present disclosure will be described with reference to the accompanying drawings.

Figure 1:
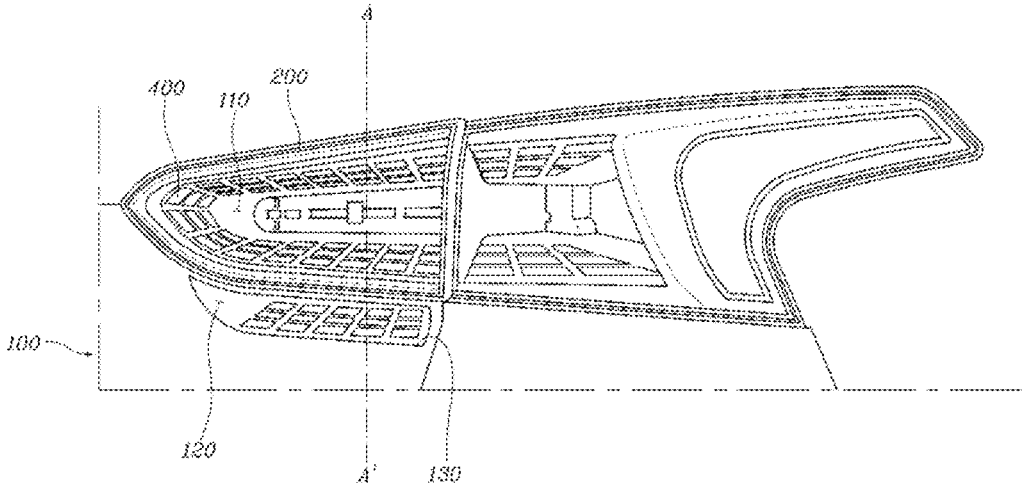
FIG. 1 is a diagram illustrating a lighting apparatus of a vehicle according to the present disclosure.
Figure 2:
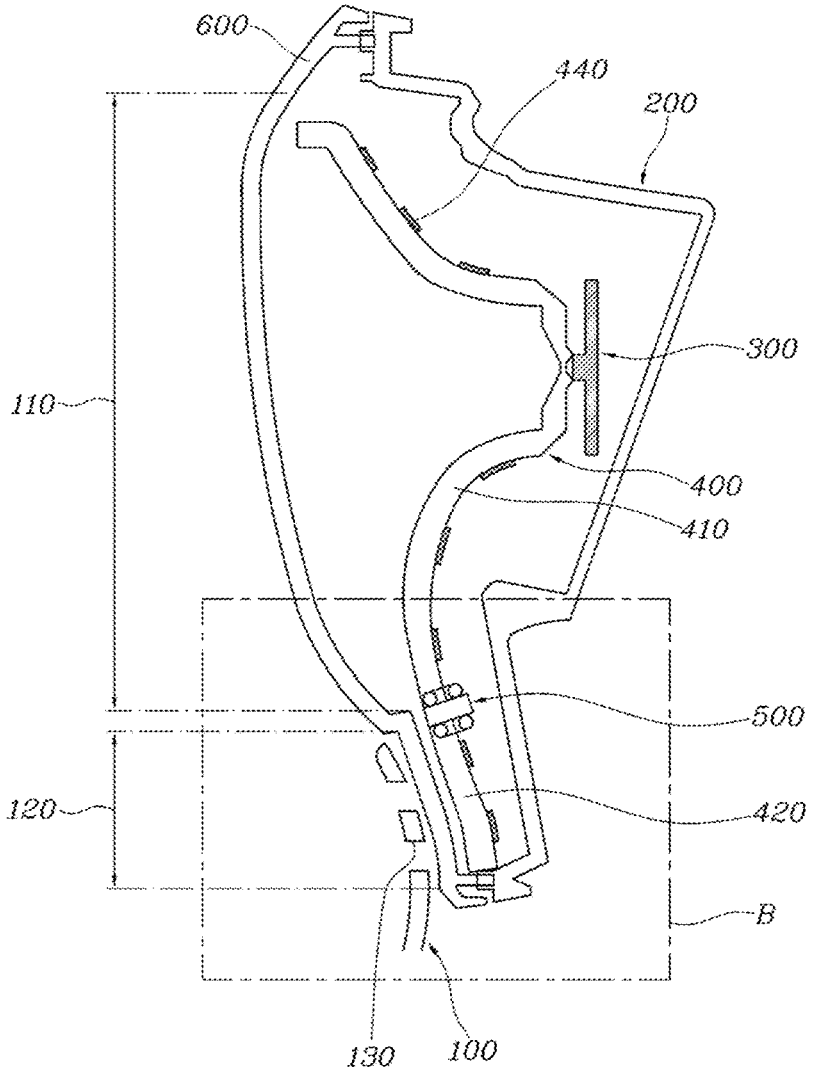
FIG. 2 is a cross-sectional view taken along line A-A' of the lighting apparatus of the vehicle shown in FIG. 1 according to the present disclosure.
Figure 3:
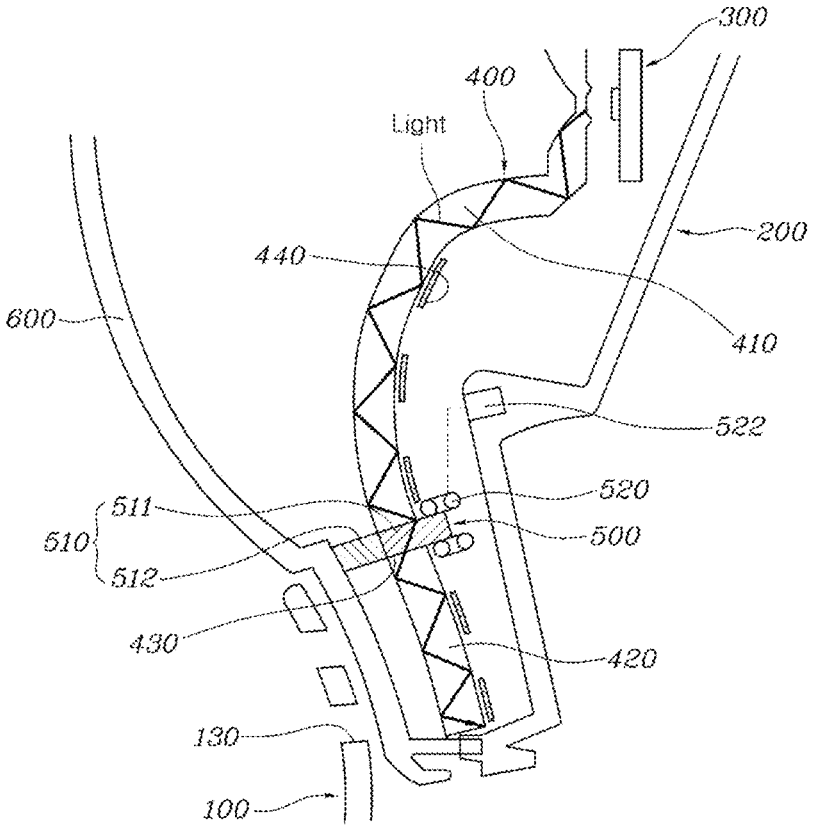
FIG. 3 is an enlarged view illustrating Portion B of the lighting apparatus of the vehicle shown in FIG. 1 according to the present disclosure.
Figure 5:
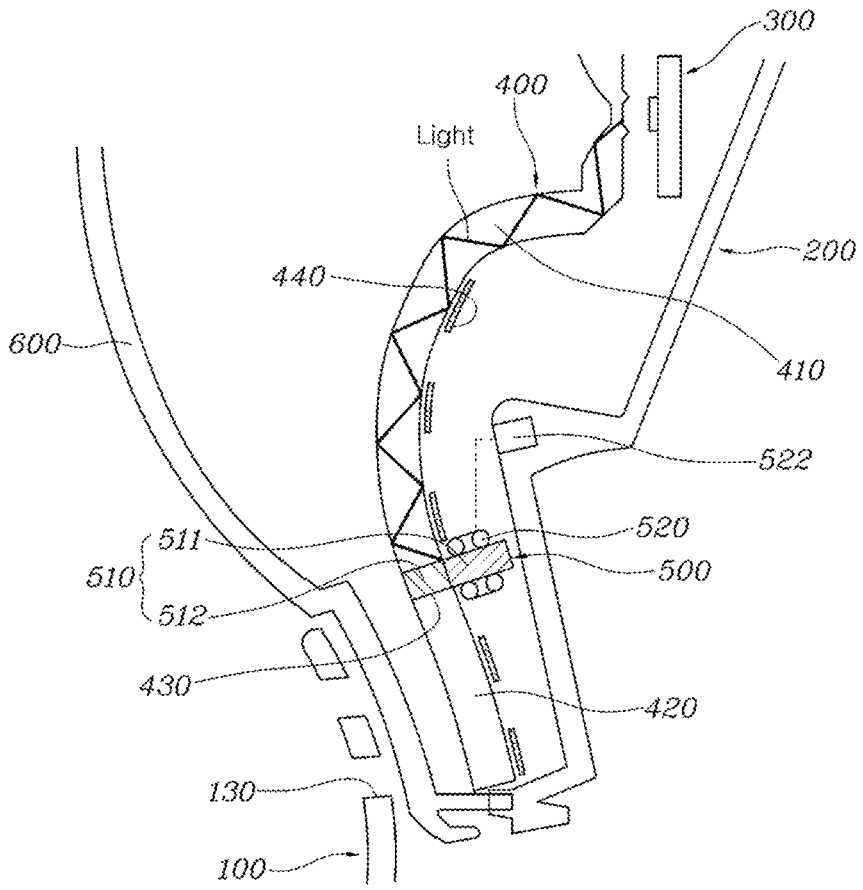
Figure 6:
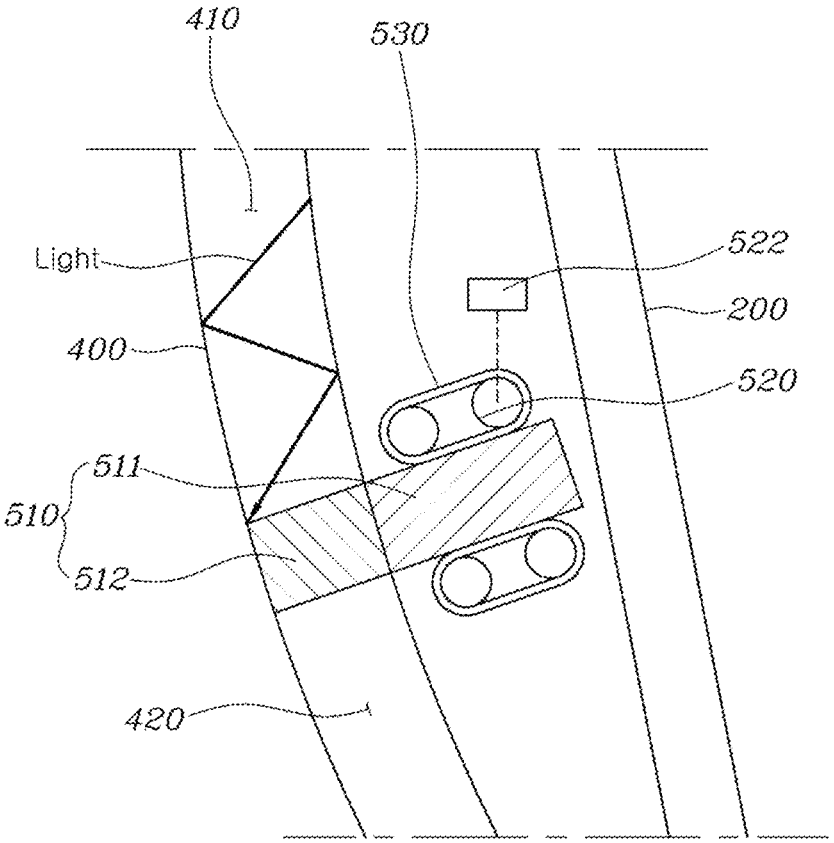
Figure 7:
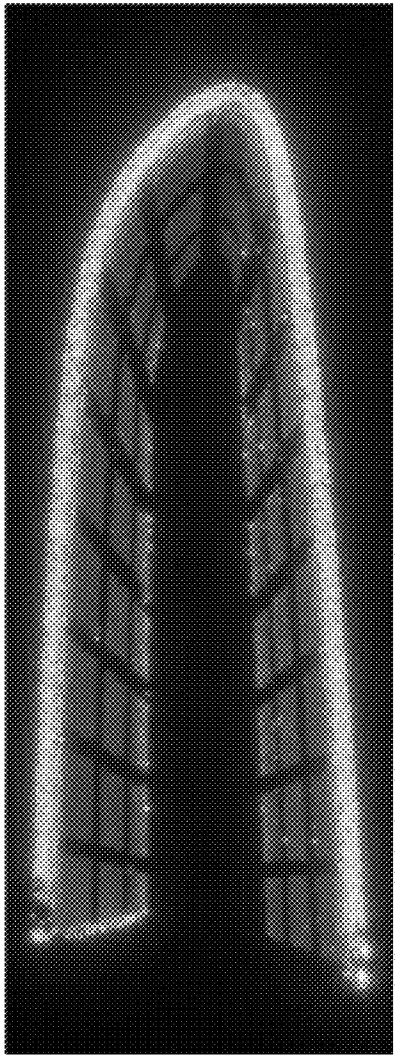
FIG. 7 is a diagram illustrating one example of a lighting image according to the present disclosure.

FIG. 1 is a diagram illustrating a lighting apparatus of a vehicle according to the present disclosure, FIG. 2 is a cross-sectional view taken along line A-A' of the lighting apparatus of the vehicle shown in FIG. 1, FIG. 3 is an enlarged view illustrating Portion B of the lighting apparatus of the vehicle shown in FIG. 1, FIGS. 4 to 6 are diagrams illustrating an operating state of the lighting apparatus of the vehicle shown in FIG. 1, and FIG. 7 is a diagram illustrating one example of a lighting image according to the present disclosure.

As shown in FIGS. 1 and 2, a lighting apparatus of a vehicle according to the present disclosure may include a vehicle body panel 100 having a main lighting area 110 and an extended lighting area 120; a housing 200 installed in the vehicle body panel 100 and formed to include the main lighting area 110 and the extended lighting area 120; a light source 300 installed in the housing 200 and configured to emit light to the outside; a light guide 400 provided to allow the light emitted from the light source 300 to be incident thereon, configured to irradiate light due to the incident light, and formed to extend from the main lighting area 110 to the extended lighting area 120; and a lighting selection mechanism 500 movably disposed at a position at which the main lighting area 110 and the extended lighting area 120 are divided in the light guide 400 and configured to selectively partition a light emission area of the light guide 400 when the lighting selection mechanism 500 is disposed at the light guide 400 or separated therefrom, thereby allowing the light to be irradiated in only the main lighting area 110 or allowing the light to be irradiated in both the main lighting area 110 and the extended lighting area 120.

The vehicle body panel 100 is an exterior of a vehicle body and may be a front portion or a rear portion of the vehicle in which a lamp module is required. In particular, the vehicle body panel 100 may include the main lighting area 110 in which the lamp module is mounted, and the extended lighting area 120 in which a light irradiation area extends in addition to the main lighting area 110. In other words, in the vehicle body panel 100, the main lighting area 110 is a portion in which a lamp module including the housing 200, the light source 300, and light guide 400 is installed, and the extended lighting area 120 is a portion in which a bumper or a grille of the vehicle is provided and a lighting aperture 130 through which light passes is formed.

As described above, the main lighting area 110 is a portion in which the lamp module is required in the vehicle body panel 100, and the extended lighting area 120 extends to the bumper or the grille of the vehicle to irradiate the light even from the bumper or the grille of the vehicle. Accordingly, the lighting aperture 130 may be formed in the bumper or the grille. When the lighting aperture 130 is formed in the bumper, an aperture for an external design may be formed separately. When the lighting aperture 130 is formed in the grille, the existing aperture may be utilized as the lighting aperture 130.

Meanwhile, the housing 200 in which the light source 300, the light guide 400, and the lighting selection mechanism 500 are installed may be mounted on the vehicle body panel 100. Since the light source 300, the light guide 400, and the lighting selection mechanism 500 may be disposed in the housing 200, it may be possible to achieve one modularization which is to be installed more easily on the vehicle body panel 100. In particular, a light-emitting diode (LED) may be applied to the light source 300, and the light guide 400 may be configured such that light irradiated from the light source 300 travels inside the light guide 400 in an extension direction and some of the light is emitted to the outside. The light guide 400 may be formed to extend from the main lighting area 110 to the extended lighting area 120 to irradiate the light emitted from the light source 300 to both the main lighting area 110 and the extended lighting area 120.

In particular, the light guide 400 may include the lighting selection mechanism 500 which is provided to be movable at a position at which the main lighting area 110 and the extended lighting area 120 are divided. The lighting selection mechanism 500 selectively partitions the light emission area of the light guide 400 based on a movement position, thereby allowing the light emission area of the light guide 400 to irradiate light in only the main lighting area 110 or to irradiate light in both the main lighting area 110 and the extended lighting area 120. As described above, the light emission area may be changed due to the lighting selection mechanism 500 to selectively change the light emission area into an external design which is required by a user, and information may be exchanged with the outside through selective light emission of the main lighting area 110 and the extended lighting area 120.

The lighting selection mechanism 500 may be operated by an electronic control unit (ECU). The lighting selection mechanism 500 may be operated based on a condition which is preset in the ECU or manipulated and operated according to an intent of the user. To describe the present disclosure in detail, as shown in FIGS. 2 and 3, the light guide 400 may include a main area 410 that corresponds to the main lighting area 110, an extension area 420 that corresponds to the extended lighting area 120, and a space area 430 disposed between the main area 410 and the extension area 420.

The light guide 400 may be made of a polymethyl metacrylate (PMMA) material and may be formed such that, when light is incident into the light guide 400, some of the light is reflected inside the light guide 400 to travel in the extension direction and the remaining of the light is emitted to the outside. An entire area of the light guide 400 may be divided into the main area 410, the space area 430, and the extension area 420. When light is emitted in the main area 410, the light may be irradiated through the main lighting area 110, and, when the light is emitted in the extension area 420, the light may be irradiated through the extended lighting area 120. The space area 430 is an invalid (e.g., a void) section between the main area 410 and the extension area 420 and the lighting selection mechanism 500 may be disposed in the space area 430 to selectively allow light to travel to the extension area 420 or selectively cut off the light.

Particularly, the light source 300 may be installed to irradiate the main area 410 in the light guide 400 with light. Although the light source 300 may be installed at any position of the light guide 400, light emission may be made generally. Since the main lighting area 110 is a basic light emission area through the lamp module in the vehicle body panel 100, it is preferable that the light source 300 is installed to irradiate the main area 410 with the light. Thus, a quantity of the light of the main area 410 in the light guide 400 may be secured to thus secure the light irradiated through the main lighting area 110.

Meanwhile, as shown in FIGS. 3 to 6, the lighting selection mechanism 500 may include a guide block 510 movably disposed in the space area 430 and configured to allow both the main area 410 and the extension area 420 to irradiate light according to a movement position or configured to prevent light from traveling to the extension area 420 to irradiate the light in only the main area 410, and a driving mechanism 520 installed to be connected to the guide block 510 and configured to selectively move the guide block 510.

As described above, the lighting selection mechanism 500 may be formed of the guide block 510 which is moved in the space area 430 of the light guide 400 and the driving mechanism 520 for moving the guide block 510. The guide block 510 may be formed to fill the space area 430 when disposed in the space area 430 of the light guide 400 and movably installed in the space area 430. In particular, the guide block 510 may be formed to extend in inward and outward directions to not be separated from the space area 430 even when moved in the space area 430. The guide block 510 may be moved in the space area 430 due to the driving mechanism 520.

Figure 4:
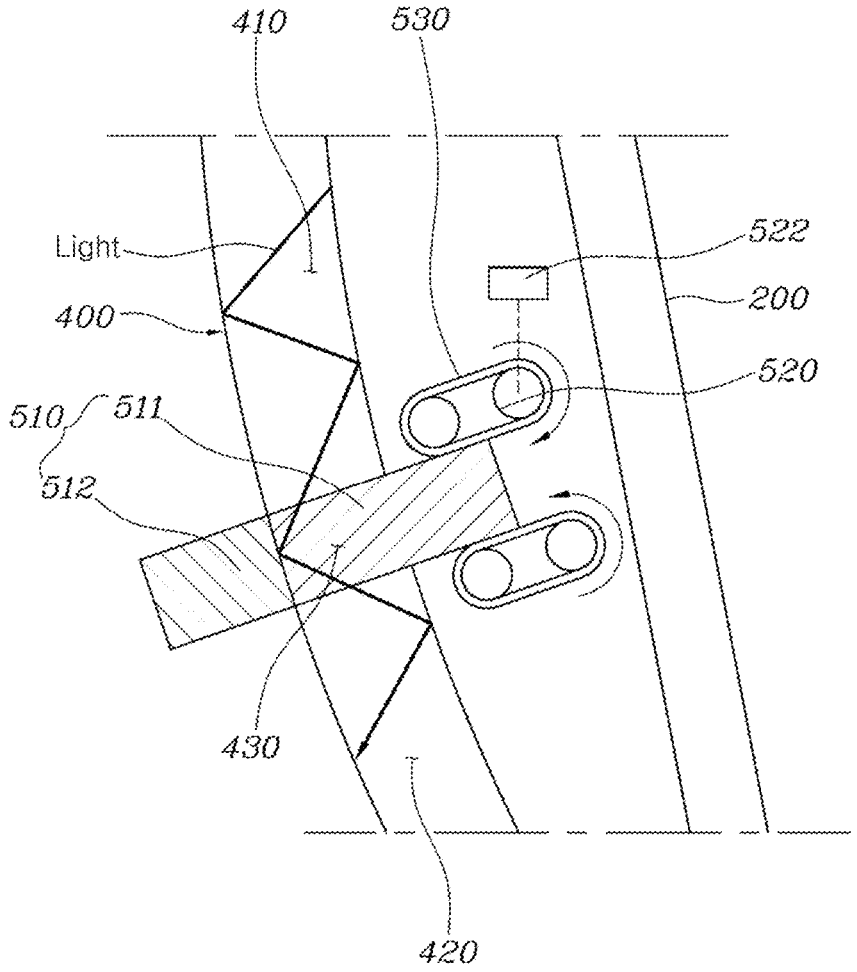
FIGS. 4 to 6 are diagrams illustrating an operating state of the lighting apparatus of the vehicle shown in FIG. 1 according to the present disclosure.

Specifically, the guide block 510 may be formed of a transparent block portion 511 which is formed to allow light to pass therethrough and a non-transparent block portion 512 which is formed to prevent light from passing therethrough. In other words, the transparent block portion 511 may be formed to be transparent to allow light to pass therethrough, and the non-transparent block portion 512 may be formed to absorb or reflect light to prevent light from passing therethrough. Thus, as shown in FIGS. 3 and 4, when the guide block 510 is moved and then the transparent block portion 511 is disposed in the space area 430, light traveling in the main area 410 may pass through the transparent block portion 511 to travel to the extension area 420 to irradiate the light in both the main area 410 and the extension area 420. In contrast, as shown in FIGS. 5 and 6, when the guide block 510 is moved and then the non-transparent block portion 512 is disposed in the space area 430, the light traveling in the main area 410 may be cut-off due to the non-transparent block portion 512 and thus does not travel to the extension area 420 to irradiate the light in only the main area 410.

Meanwhile, referring to FIG. 4, the driving mechanism 520 may be formed of a roller 521 provided to come into contact with a side end of the guide block 510 in a direction in which the guide block 510 is moved, and a driver 522 configured to provide a driving force to rotate the roller 521. As described above, the driving mechanism 520 may be formed of the roller 521 and the driver 522, and the guide block 510 may be moved by the roller 521 which is rotated when the driver 522 operates. In particular, since the roller 521 comes into contact with the guide block 510, a movement direction of the guide block 510 may be determined according to a rotation direction of the roller 521. The driver 522 for rotating the roller 521 may be formed as a motor configured to rotate in forward and reverse directions.

As described above, the driving mechanism 520 may be configured to rotate the guide block 510 through a rotational motion of the roller 521 to perform smooth movement of the guide block 510. In addition, similar to a solenoid method, when the guide block 510 is drawn out or drawn in, an impact sound may be generated. Thus, the guide block 510 may be moved through the rotational motion of the roller 521 to prevent the generation of noise.

In addition to the above description, the roller 521 may be formed as a plurality of rollers 521 spaced apart from each other in a length direction of the guide block 510, and a friction belt 530 that surrounds each roller 521 my be interposed between the roller 521 and the guide block 510 to rotate the friction belt 530 due to rotation of the roller 521 to move the guide block 510. As described above, a structure in which the friction belt 530 surrounds the plurality of rollers 521 disposed to be spaced apart from each other in the length direction of the guide block 510 is achieved to form a track to thus move the guide block 510 in contact with the friction belt 530 due to rotational motion of the friction belt 530. Thus, a contact area between the friction belt 530 and the guide block 510 may increase thus performing more accurate movement of the guide block 510 due to the rotation of the friction belt 530. The roller 521 and the friction belt 530 may be provided as a plurality of rollers 521 and a plurality of friction belts 530 at the side end of the guide block 510.

Meanwhile, as shown in FIG. 2, the light guide 400 may be formed in a shape in which the main area 410 is bent inward to be recessed, and the light source 300 may be installed to emit light toward an end of the bent portion of the light guide 400. As described above, since the light guide 400 may be formed in the shape of being bent inward to be recessed, a lighting image through light emission of the light guide 400 may be implemented in the form of extending inward and outward. In particular, since the light source 300 is installed to emit light toward the end of the bent portion of the light guide 400, the light may be distributed more smoothly to the entire area of the light guide 400.

In addition, the light guide 400 may include an image forming portion 440 configured to cut off or scatter light in the extension direction to determine the lighting image emitted through the light guide 400. Particular, the image forming portion 440 may cut off reflection of light or scatter the light through a fine protrude or a fine groove so that the light guide 400 allows the light not to be irradiated or to be formed in a portion in which the image forming portion 440 is formed. Consequently, the lighting image according to the light emission from the light guide 400 may be determined, and various lighting images may be implemented by changing a position and a structure of the image forming portion 440. For example, when the image forming portion 440 is formed in a grid shape in the light guide 400, a lighting image as shown in FIG. 7 may be implemented.

Meanwhile, an outer lens 600 which is installed in the housing 200, formed to cover the light guide 400, and configured to allow light to pass therethrough is further provided so that it is possible to protect each component installed in the housing 200 from contamination and collision. The outer lens 600 may be exposed to the outside in the main lighting area 110 and disposed inside the vehicle body panel 100 in the extended lighting area 120. Thus, one outer lens 600 may be used so that the exterior design of the vehicle body of the lamp module may be maintained, and the main lighting area 110 and the extended lighting area 120 may be covered by the one outer lens 600.

The lighting apparatus of the vehicle, which is formed in the above described structure, allows irradiation of light to be diffused into a surrounding area together with a lighting area in which the light is irradiated and thus the light is irradiated even from a bumper or a grille of the vehicle so that an exterior design of the vehicle may be improved. In addition, in an area in which the irradiation of the light is diffused in the vehicle in addition to the lighting area, the diffusion of the light may be selectively determined to thus increase a degree of design freedom of an exterior lighting design.

In accordance with the present disclosure, a lighting apparatus of a vehicle, which is formed in the above described structure, allows irradiation of light to be diffused into a surrounding area together with a lighting area in which the light is irradiated and thus the light may be irradiated even from a bumper or a grille of the vehicle thus improving an exterior design of the vehicle. In addition, in an area in which the irradiation of the light is diffused in the vehicle in addition to the lighting area, the diffusion of the light may be selectively determined to thus increase a degree of design freedom of an exterior lighting design.

Although exemplary embodiments of the present disclosure have been described for illustrative purposes, those skilled in the art will appreciate that various modifications, additions and substitutions are possible, without departing from the scope and spirit of the present disclosure as disclosed in the appended claims.

The invention claimed is:

1. A lighting apparatus of a vehicle, comprising:

a vehicle body panel having a main lighting area and an extended lighting area;

a housing installed in the vehicle body panel and formed to include the main lighting area and the extended lighting area;

a light source installed in the housing and configured to emit light to the outside;

a light guide that allows the light emitted from the light source to be incident thereon, is configured to irradiate light due to the incident light, and formed to extend from the main lighting area to the extended lighting area; and a light selection mechanism located along the light guide where the main lighting area and the extended lighting area are physically divided by a space area, the light selection mechanism being selectively insertable into the space area to fill the space area thereby allowing light to either transmit and/or diffract as the light crosses from the main lighting area, through the light selection mechanism and out to the extended lighting area.

2. The lighting apparatus of claim 1, wherein the light guide includes a main area that corresponds to the main lighting area, an extension area that corresponds to the extended lighting area, and the space area formed between the main area and the extension area.

3. The lighting apparatus of claim 2, wherein the light source is installed such that the light guide irradiates light toward the main area.

4. The lighting apparatus of claim 2, wherein the light selection mechanism includes:

a guide block movably disposed in the space area and allowing both the main area and the extension area to irradiate light based on a movement position or configured to prevent light from traveling to the extension area to irradiate the light in only the main area; and a driving mechanism installed to be connected to the guide block and configured to selectively move the guide block.

5. The lighting apparatus of claim 4, wherein the guide block includes a transparent block portion formed to allow light to pass therethrough and a non-transparent block portion formed to prevent the light from passing therethrough.

6. The lighting apparatus of claim 4, wherein the driving mechanism includes a roller disposed to come into contact with a side end of the guide block in a direction in which the guide block is moved, and a driver configured to provide a driving force to rotate the roller.

7. The lighting apparatus of claim 6, wherein:

the roller is provided as a plurality of rollers spaced apart from each other in a length direction of the guide block; and a friction belt surrounding each roller is interposed between the roller and the guide block to rotate the friction belt due to rotation of the roller to move the guide block.

8. The lighting apparatus of claim 2, wherein:

the light guide is formed in a shape in which the main area is bent inward to be recessed; and the light source is installed to emit light toward an end of a bent portion of the light guide.

9. The lighting apparatus of claim 1, wherein the light guide includes an image forming portion configured to cut off or scatter light in an extension direction to determine a lighting image emitted through the light guide.

10. The lighting apparatus of claim 1, further comprising:

an outer lens installed in the housing, formed to cover the light guide, and allowing light to pass therethrough.

11. The lighting apparatus of claim 1, wherein, in the vehicle body panel, the main lighting area is a portion in which a lamp module including the housing, the light source, and the light guide is installed, and the extended lighting area is a portion in which a bumper or a grille of the vehicle is provided and a lighting aperture through which light passes is formed.

* * * * *